US005718107A

United States Patent [19]

Catallo

[11] Patent Number: 5,718,107

[45] Date of Patent: Feb. 17, 1998

[54] FABRIC DETWISTER

[76] Inventor: Frank Catallo, 75 Channel Dr., Port Washington, N.Y. 11050

[21] Appl. No.: 774,657

[22] Filed: Dec. 30, 1996

[51] Int. Cl.[6] ..... D06C 3/06

[52] U.S. Cl. ..... 57/1 UN; 26/71

[58] Field of Search ..... 57/1 UN, 2.3, 57/2.5, 31; 26/71, 74, 80, 84, 87

[56] References Cited

U.S. PATENT DOCUMENTS 2,117,603 5/1938 Dungler ..... 57/1 UN
4,329,838 5/1982 Zerle et al. ..... 57/1 UN
4,631,911 12/1986 Young, Jr. et al. ..... 26/99
4,766,719 8/1988 Young, Jr. et al. ..... 57/1 UN

*Primary Examiner*—C. D. Crowder
*Assistant Examiner*—Larry D. Worrell, Jr.
*Attorney, Agent, or Firm*—Leo Fornero

[57] ABSTRACT

A fabric detwister for continuously opening roped knitted fabric operating to open the roped fabric by moving the detwister arrangement in the direction of twist and as this occurs it actuated the turntable to move in the direction to remove the twist.

5 Claims, 3 Drawing Sheets

FABRIC DETWISTER

BACKGROUND OF THE INVENTION

The invention relates to the finishing of, what are called in the art, roped knitted fabrics and particularly the apparatus for accomplishing a pan of the finishing known as a detwister.

The concept herein discloses a detwister for removing the twist from fabrics requiring processing in a continuous and efficient manner when compared to prior art systems and in a more efficient manner with less equipment.

SUMMARY OF THE INVENTION

The detwister disclosed herein incorporates various components that cooperate to open the roped fabric as the cloth moves vertically over the ring guiders where it opens the fabric in the direction of twist. As this opening occurs a sensing device disposed to sense the direction of twist actuates the turntable including the roped fabric, usually in a truck, to rotate in the direction to remove the twist. It is well known in the art that twisted roped fabric will, upon opening as it moves through finishing apparatus will rotate as it becomes untwisted as in this application and such fabric causes the ring guides to pivot as they are pivotably mounted on a mechanism shown in the drawings and particularly FIGS. 3 and 4. This will be clear to one skilled in the art.

Accordingly it is an object of the present invention to provide apparatus for removing the twist in roped knitted fabric which does so efficiently.

Also it is an object of this invention to provide such apparatus for detwisting the fabric which is easy to operate and inexpensive to manufacture.

Broadly the detwister contemplated herein comprises components that unravel the twist which is in a cloth truck mounted on a turntable. From the truck the fabric is moved to the detwister also shown in FIG. 1 and through a poteye and over ring guiders where the fabric twist accumulates in the direction of twist all best seen in FIG. 2. A sensing member set as desired to sense the direction of twist communicates this information to the turntable which is actuated to move in a direction to remove the twist.

Detwisting apparatus of the type contemplated herein, generally, comprises a turntable for the truck delivery arrangement which contains the roped knitted fabric. A poteye arranged at one end of a vertical frame which supports a spreader having ring guiders mounted on the horizontal ends in order to engage the fabric as it moves through the spreader. The horizontal frame is pivotably mounted about the vertical time so that as the fabric moves over the ring guiders it tends to move the ring guider assembly in the direction of twist. The ring guiders are of a well known form and of a kind commonly used in the art and are shown in FIG. 2 as devices attached to the edge guides and pivotal about the arm 15. A sensing device is arranged in any well known fashion to sense this direction of twist and also to signal the movable portion of the turntable to move in the direction to remove the twist. Such sensing devices may take various forms as they are well known in the art.

BRIEF DESCRIPTION OF THE DRAWINGS

In the drawings wherein like reference numerals denote corresponding parts through the several views.

DETAILED DESCRIPTION OF THE DRAWINGS

Figure 1:
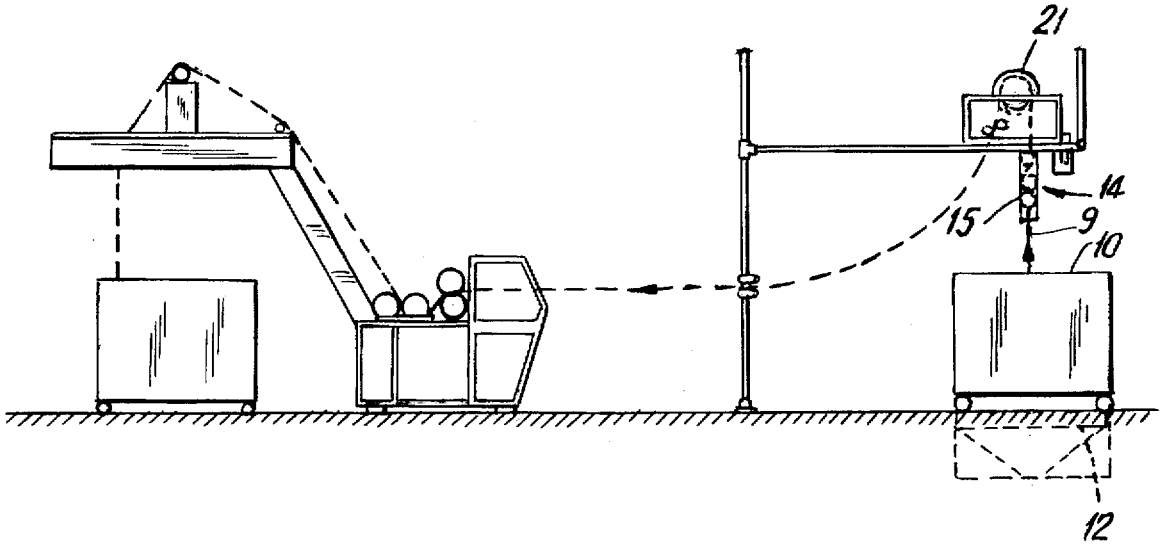
FIG. 1 is a schematic view of an arrangement illustrating the apparatus for removing twist including the turnable and truck and a truck for removing the detwisted fabric for other treating.
Figure 2:
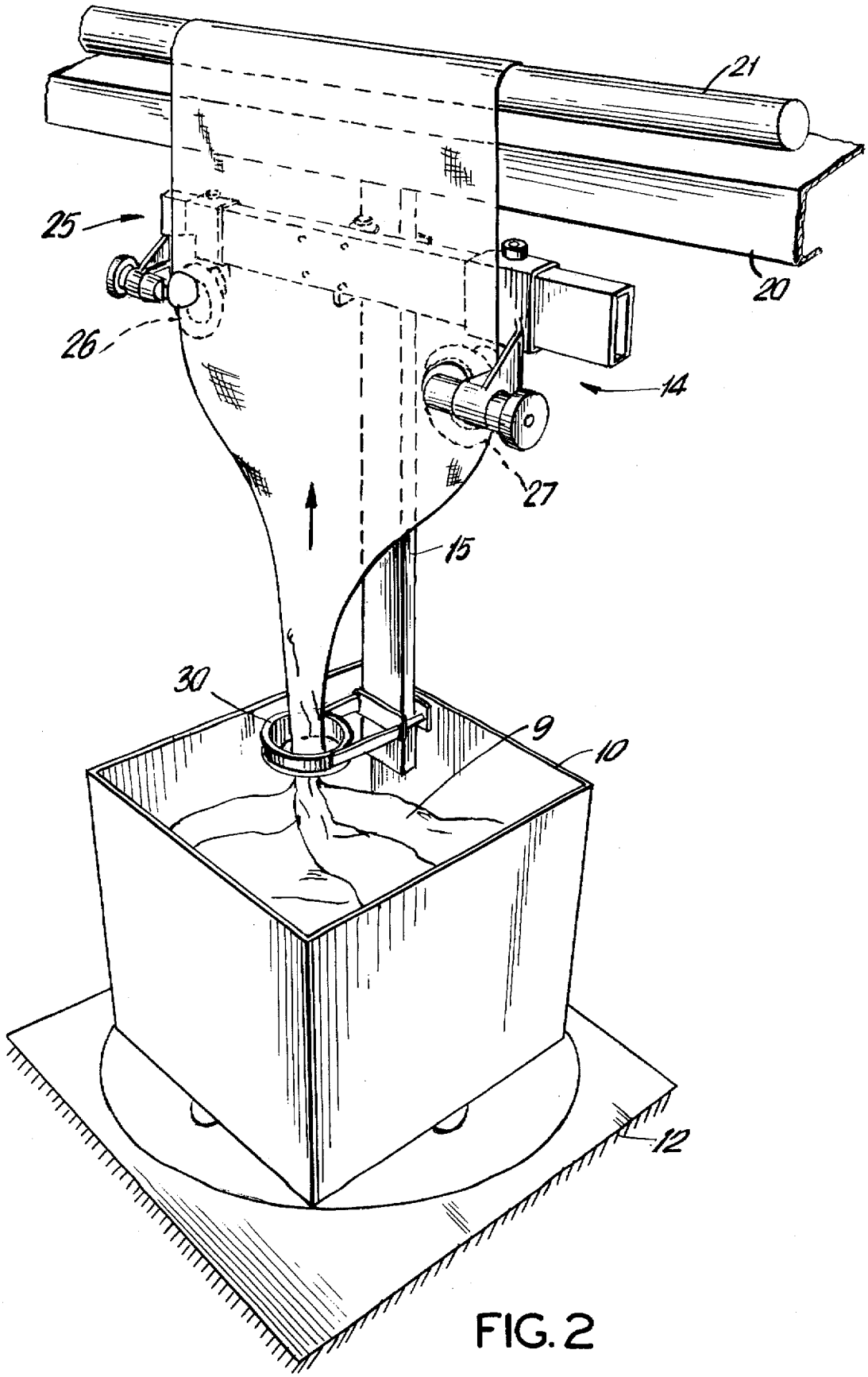
FIG. 2 is a view of the specific detwisting arrangement including the elements of the invention contemplated herein.

Referring to FIG. 1, the invention disclosed herein is shown as part of a system for detwisting roped knitted fabric 9 provided in a track 10 mounted on a well known turntable 12. Spaced relative the turntable 12 is a time arrangement 14 serving to support a vertically disposed arm 15 with a pot eye 30 at the lower end. At the other end mounted to the frame 20 is a fabric drying roll 21. The frame 20 is shown in part as different arrangements may be utilized in the invention.

The vertically disposed arm 15 also serves to pivotably support a horizontal frame which is part of a spreader arrangement 25 having ring guides 26 and 27 mounted on each of its ends and spaced for easy connection to the fabric 9 so that these ring guides may function to rotate the fabric 9 in the direction of twist after the fabric passes through poteye 30 which is mounted on the lower end of the arm 15.

Figure 3:
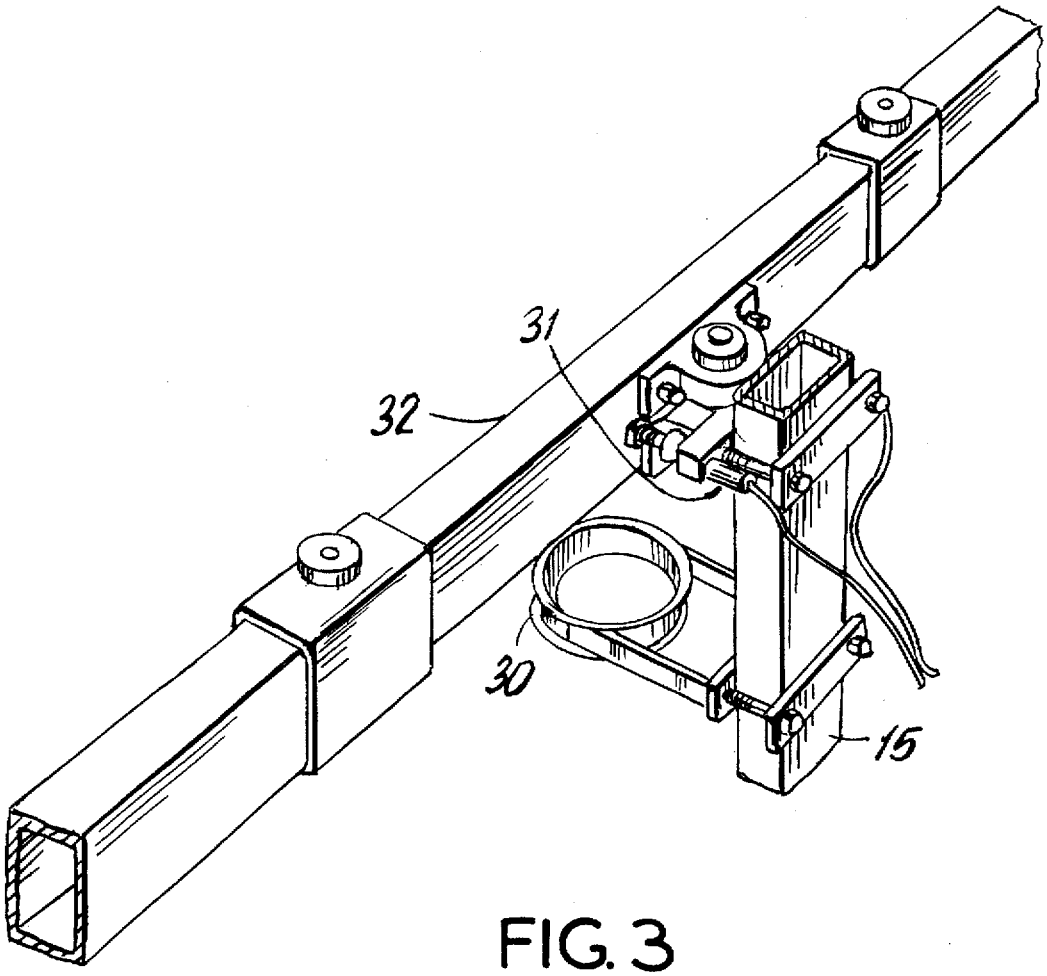
FIG. 3 is a view showing a type of sensor.
Figure 4:
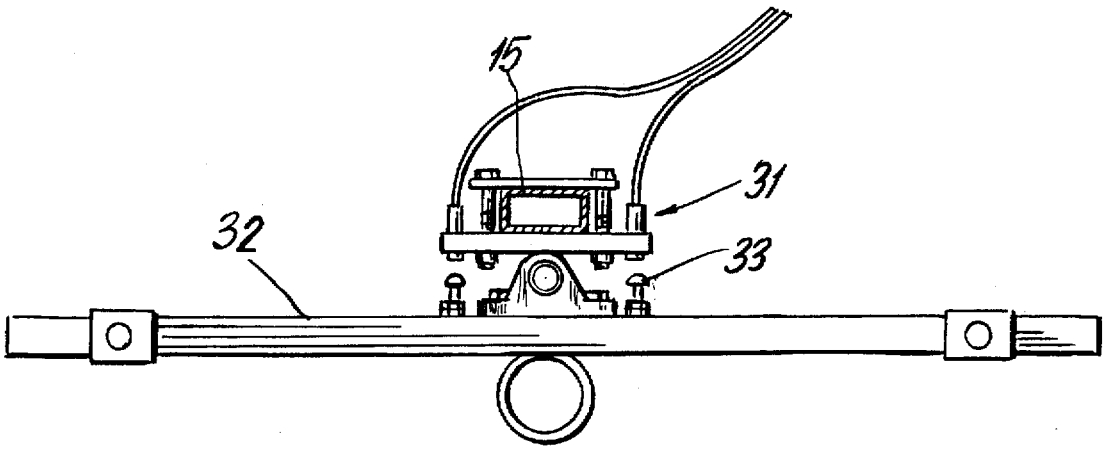
FIG. 4 is a top view of FIG. 2 also showing the rotation member for the frame.

A sensing means 31 well known in the art is attached to the vertically disposed arm 15 as shown in FIG. 3. Sensing reflectors 33 are provided for. The fabric twist rotates the horizontal frame 32 in response to the fabric twist signals. It should be understood that of course specific forms of the invention herein illustrated and described are intended to be representative only as certain changes may be made in the invention without departing from the clear teachings of the disclosure. Accordingly reference should be made to the following appended claims determining the full scope of the invention.

I claim:

1. A detwister for opening up to flat form a moving roped knitted fabric comprising;

(a) means for holding the roped knitted fabric;

(b) a turntable means for supporting the means for holding the roped knitted fabric;

(c) an arm member for said detwister having a pot eye mounted and located relative the means for holding the roped knitted fabric to receive same as it moves;

(d) ring guider arrangement for connection to the fabric edges also mounted on the arm member to move roped knitted fabric through the poteye;

(e) the ring guider arrangement as it moves roped knitted fabric through the poteye is rotatably mounted and disposed on the arm member to rotate to cooperate and to move same in the direction of fabric twist, and (f) a sensing device for said detwister and connected to said turntable to signal the turntable to move in the direction of fabric twist.

2. The detwister of claim 1 wherein said ring guider arrangement is part of a spreader which is mounted on a pivotal frame member.

3. The detwister of claim 2 wherein said pivotal member is mounted on a horizontally disposed beam and said beam being connected to the top of the arm member.

4. The detwister of claim 3 wherein said pivotal member is mounted to move fabric in the direction of fabric twist.

5. The detwister of claim 4 includes a sensing device connected to the turntable to signal the turntable to move in the direction of fabric twist and functions to remove said twist.

* * * * *

UNITED STATES PATENT AND TRADEMARK OFFICE

CERTIFICATE OF CORRECTION

PATENT NO. : 5,718,107

DATED : February 17, 1998

INVENTOR(S) : Frank CATALLO

It is certified that error appears in the above-identified patent and that said Letters Patent is hereby corrected as shown below:

In column 1, line 7, "pan" should be --part--; in line 49, "time" should be --frame--.

In column 2, line 10, "track" should be --truck--; in line 11, "time" should be --frame--; in line 14, "drying" should be --driving--.

Signed and Sealed this

Twenty-fourth Day of November, 1998

*Attest:*

*Attesting Officer*

Bruce Lehman

BRUCE LEHMAN

*Commissioner of Patents and Trademarks*